US009903663B2

(12) United States Patent
Hartfield

(10) Patent No.: US 9,903,663 B2
(45) Date of Patent: Feb. 27, 2018

(54) BRAZED HEAT EXCHANGER WITH FLUID FLOW TO SERIALLY EXCHANGE HEAT WITH DIFFERENT REFRIGERANT CIRCUITS

(71) Applicant: TRANE INTERNATIONAL INC., Piscataway, NJ (US)

(72) Inventor: Jon P. Hartfield, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 418 days.

(21) Appl. No.: 14/539,170

(22) Filed: Nov. 12, 2014

(65) Prior Publication Data

US 2016/0131433 A1 May 12, 2016

Related U.S. Application Data

(60) Provisional application No. 61/903,290, filed on Nov. 12, 2013.

(51) Int. Cl.

| | |
|---|---|
| ***F28F 3/00*** | (2006.01) |
| ***F28D 9/00*** | (2006.01) |
| ***F28F 3/04*** | (2006.01) |

(52) U.S. Cl.
CPC ..... *F28D 9/0093* (2013.01); *F28D 9/005* (2013.01); *F28F 3/046* (2013.01)

(58) Field of Classification Search
CPC ..... F28D 9/005; F28D 9/0093; F28F 3/046
See application file for complete search history.

(56) References Cited

U.S. PATENT DOCUMENTS 8,443,869 B2 * 5/2013 Lavanchy ..... F28B 1/02 165/145
8,505,324 B2 * 8/2013 Goodfellow ..... F25B 41/00 62/335

(Continued)

FOREIGN PATENT DOCUMENTS

CN 101611285 A 12/2009
CN 101936670 A 1/2011

(Continued)

OTHER PUBLICATIONS

EP 0801281 A2 machine translation.*
Office Action, Chinese Patent Application No. 201410635889.0, dated Oct. 19, 2017, with partial English translation (9 pages).

*Primary Examiner* — Len Tran
*Assistant Examiner* — Gordon Jones
(74) *Attorney, Agent, or Firm* — Hamre, Schumann, Mueller & Larson, P.C.

(57) ABSTRACT

Apparatuses and methods described herein relate to brazed heat exchangers, which may be used for example in a heating, ventilation, and air conditioning system (HVAC) system and/or unit thereof. The heat exchanger includes a fluid flow structure to allow a fluid stream, for example a chilled fluid stream to exchange heat serially with more than one refrigerant circuit, where each refrigerant circuit is a distinct and independent refrigerant circuit. Generally, an apparatus to exchange heat serially with more than one heat exchange fluid circuit includes an internal flow path that allows a working fluid to flow through a first brazed heat exchanger, through one or more internal routing channels, and through a second brazed heat exchanger.

16 Claims, 5 Drawing Sheets

(56) References Cited

U.S. PATENT DOCUMENTS

| | | | | |
|---|---|---|---|---|
| 2005/0103032 | A1* | 5/2005 | Pierson | F01K 23/10 62/175 |
| 2010/0132929 | A1* | 6/2010 | Fernandez | F28D 9/0037 165/164 |
| 2011/0030403 | A1* | 2/2011 | Kondou | F25B 5/04 62/197 |
| 2013/0292101 | A1* | 11/2013 | Denoual | F28D 9/005 165/166 |
| 2015/0300743 | A1* | 10/2015 | Persson | F28D 9/005 165/166 |
| 2016/0201990 | A1* | 7/2016 | Voorhis, Jr. | F28D 1/05316 165/174 |

FOREIGN PATENT DOCUMENTS

| | | | | |
|---|---|---|---|---|
| CN | 101999061 | A | 3/2011 | |
| EP | 0165179 | A1 * | 12/1985 | F28D 9/0037 |
| EP | 0801281 | A2 * | 10/1997 | F28B 1/06 |
| EP | 2410278 | A1 | 1/2012 | |

* cited by examiner

BRAZED HEAT EXCHANGER WITH FLUID FLOW TO SERIALLY EXCHANGE HEAT WITH DIFFERENT REFRIGERANT CIRCUITS

FIELD

The disclosure herein relates to a heat exchanger, such as for example a brazed heat exchanger, which may be a brazed plate heat exchanger, and which may be used for example in a heating, ventilation, and air conditioning system (HVAC) system and/or unit thereof. The heat exchanger includes a flow structure to allow a fluid stream, for example a chilled fluid stream to exchange heat serially with more than one refrigerant circuit where each refrigerant circuit is a distinct and independent refrigerant circuit.

BACKGROUND

Heat exchangers that may be used for example in HVAC systems can include various types of heat exchangers, for example brazed heat exchangers.

SUMMARY

Brazed heat exchangers are described, and which may be brazed plate heat exchangers, and used for example in a heating, ventilation, and air conditioning system (HVAC) system and/or unit thereof.

Generally, the heat exchanger includes a flow structure to allow a fluid stream, for example a chilled fluid stream to exchange heat serially with more than one refrigerant circuit where each refrigerant circuit is a distinct and independent refrigerant circuit.

In one embodiment, an apparatus to exchange heat serially with more than one heat exchange fluid circuit includes an internal flow path that allows a working fluid to flow through a first brazed heat exchanger, through one or more internal routing channels, and through a second brazed heat exchanger.

In one embodiment, the first brazed heat exchanger has a working fluid inlet in fluid communication with a working fluid circuit, and a first heat exchanger fluid inlet and outlet in fluid communication with a first heat exchange fluid circuit. The first heat exchanger fluid inlet and outlet are configured to allow fluid flow of a first heat exchange fluid into and out of the first brazed heat exchanger. The first brazed heat exchanger includes working fluid flow channels in fluid communication with the working fluid inlet, and includes first heat exchanger fluid flow channels in fluid communication with the first heat exchanger fluid inlet and outlet. The working fluid flow channels are configured relative to the first heat exchanger fluid flow channels so that the working fluid flowing through the working fluid flow channels exchanges heat with the first heat exchange fluid flowing through the first heat exchanger fluid channels. The internal flow path includes the working fluid flow channels of the first brazed heat exchanger and the one or more internal routing channels.

In one embodiment, the second brazed heat exchanger has working fluid flow channels in fluid communication with the one or more internal routing channels. The second brazed heat exchanger includes a second heat exchanger fluid inlet and outlet in fluid communication with a second heat exchange fluid circuit that is separate from the first heat exchange fluid circuit. The second heat exchanger fluid inlet and outlet are configured to allow fluid flow of a second heat exchange fluid into and out of the second brazed heat exchanger. The second brazed heat exchanger includes second heat exchanger fluid flow channels in fluid communication with the second heat exchanger fluid inlet and outlet. The working fluid channels of the second brazed heat exchanger are configured relative to the second heat exchanger fluid flow channels so that the working fluid flowing through the working fluid flow channels exchanges heat with the second heat exchange fluid flowing through the second heat exchanger fluid channels. The second brazed heat exchanger includes an outlet in fluid communication with the working fluid flow channels of the second brazed heat exchanger. The internal flow path includes the working fluid flow channels of the second brazed heat exchanger.

The internal flow path thus comprises the working fluid flow channels of the first brazed heat exchanger, the one or more internal routing channels, and the working fluid flow channels of the second brazed heat exchanger. The one or more internal routing channels are in fluid communication with the working fluid flow channels, such that the working fluid exits the first brazed heat exchanger and enters the second brazed heat exchanger internally of the apparatus, and so that working fluid does not route from an external exit of the first brazed heat exchanger and does not route to an external entrance of the second brazed heat exchanger.

By "internal" flow path, it is meant that that fluid flow from the first heat exchanger to the second heat exchanger is not from an external outlet of the first heat exchanger to an external inlet of the second heat exchanger.

In one embodiment, the first and/or the second brazed heat exchangers are brazed plate heat exchangers.

In one embodiment, the internal routing channel(s) can be disposed between the first and second brazed heat exchangers.

In one embodiment, a divider is disposed between the first and second brazed heat exchangers.

In one embodiment, the one or more routing channels make up the divider between the first and second heat exchangers.

In one embodiment, the first brazed heat exchanger, the one or more routing channels, and the second brazed heat exchanger are constructed and arranged as a single unit, without external piping for the internal flow path. In one embodiment, the apparatus is a single entity, constructed and arranged as a single component.

In one embodiment, the configuration of the working fluid flow channels relative to the heat exchanger fluid flow channels, in the first and/or second brazed heat exchanger, can be constructed and arranged in various ways that include but are not limited to counter flow, parallel flow, cross flow, or the like.

In one embodiment, the apparatus and heat exchangers used therein can be implemented in a cascade effect using multiple heat exchange fluid circuits, which may run through a single apparatus or employ multiple apparatuses herein to account for the number of heat exchange fluid circuits leveraged.

In one embodiment, a method to exchange heat from a working fluid serially with more than one heat exchange fluid circuit includes directing a working fluid through an internal flow path that directs the working fluid to flow through a first brazed heat exchanger, through one or more internal routing channels, and through a second brazed heat exchanger.

In one embodiment, the method includes directing the working fluid into an inlet of the first brazed heat exchanger, and directing a first heat exchange fluid into another inlet of the first heat exchanger. The working fluid is directed through working fluid channels of the first brazed heat exchanger, and the first heat exchange fluid is directed through first heat exchanger fluid channels. The working fluid flowing through the working fluid channels of the first brazed heat exchanger exchanges heat with the first heat exchange fluid flowing through the first heat exchanger fluid channels. The working fluid is directed to one or more internal routing channels, and is internally routed to the second brazed heat exchanger, and through working fluid channels of the second heat exchanger. A second heat exchange fluid is directed into an inlet of the second brazed heat exchanger and through second heat exchanger fluid channels. The working fluid flowing through the working fluid flow channels of the second brazed heat exchanger exchanges heat with the second heat exchange fluid flowing through the second heat exchanger fluid channels. The working fluid is directed to an outlet in fluid communication with the working fluid flow channels of the second brazed heat exchanger.

The apparatuses and methods herein and the brazed heat exchangers described herein may be used for example in a heating, ventilation, and air conditioning system (HVAC) system and/or unit thereof. For example, the apparatuses and methods herein can be used with various types of water chillers, that may use various types of compressors including but not limited to scroll, screw, reciprocating compressors, and that may have varying capacities including but not limited to about 10 ton to about 100 ton cooling capacity, which may make use of the compact and low inventory requirements of brazed heat exchangers. It will be appreciated, however, that as certain designs become larger, such as for example, at about 120 tons to higher at about 150 tons to about 250 tons, where flow rates and distributions may be adequately addressed to avail use of brazed heat exchangers.

In one embodiment, the HVAC systems and/or units in which the apparatuses and methods herein may be suitable can include scroll compressor water chillers at about 10 ton to about 100 ton cooling capacity.

Other features and aspects of the embodiments will become apparent by consideration of the following detailed description and accompanying drawings.

BRIEF DESCRIPTION OF THE DRAWINGS

Reference is now made to the drawings in which like reference numbers represent corresponding parts throughout.

FIG. 4A shows a side sectional view. FIG. 4B shows a front view.

FIG. 5A shows a front view. FIG. 5B shows a side sectional view.

DETAILED DESCRIPTION

Apparatuses and methods that employ brazed heat exchangers are described, and which the brazed heat exchangers may be brazed plate heat exchangers, and can used for example in a heating, ventilation, and air conditioning system (HVAC) system and/or unit thereof. The heat exchanger includes a flow structure to allow a fluid stream, for example a chilled fluid stream to exchange heat serially with more than one refrigerant circuit where each refrigerant circuit is a distinct and independent refrigerant circuit. Generally, an apparatus to exchange heat serially with more than one heat exchange fluid circuit includes an internal flow path that allows a working fluid to flow through a first brazed heat exchanger, through one or more internal routing channels, and through a second brazed heat exchanger.

With some reference first to brazed heat exchangers, flow management for example in a single, brazed heat exchanger can allow chilled fluid to exchange heat from one refrigerant circuit to one or more other circuits in a series fashion. A series arrangement can leverage the temperature cascade effect from the multiple refrigerant circuits to enhance the thermodynamic cycle efficiency, for example in a refrigeration process.

In the example of a refrigeration or chiller system comprised of multiple (more than one) refrigerant circuits, the arrangement of the source and sink streams relative to the individual refrigerant circuits can be leveraged to improve the overall efficiency, e.g. coefficient of performance (COP), of the refrigeration system. As one example, for a system composed of two independent refrigerant circuits, if the source (chilled fluid) stream exchanges heat with one circuit followed by the other in series, the average temperature of the saturated refrigerant leaving one circuit is higher than when the source stream interacts with both circuits simultaneously or in parallel.

A brazed heat exchanger, for example a brazed plate heat exchanger (BPHE) is composed of corrugated metallic sheets which are in turn brazed together. Such a construction can offer some advantages and may be deployed in chiller or refrigeration systems such as for example in evaporators, condensers, subcoolers, economizers, oil coolers as some examples. Generally, a BPHE can include very compact profile and footprints, can have low internal (fluid) volume, and a unified and rigid structure. The components of the BPHE are brazed together during its construction and the result is a single, unified heat exchanger which can be attached into a larger system.

Figure 1:
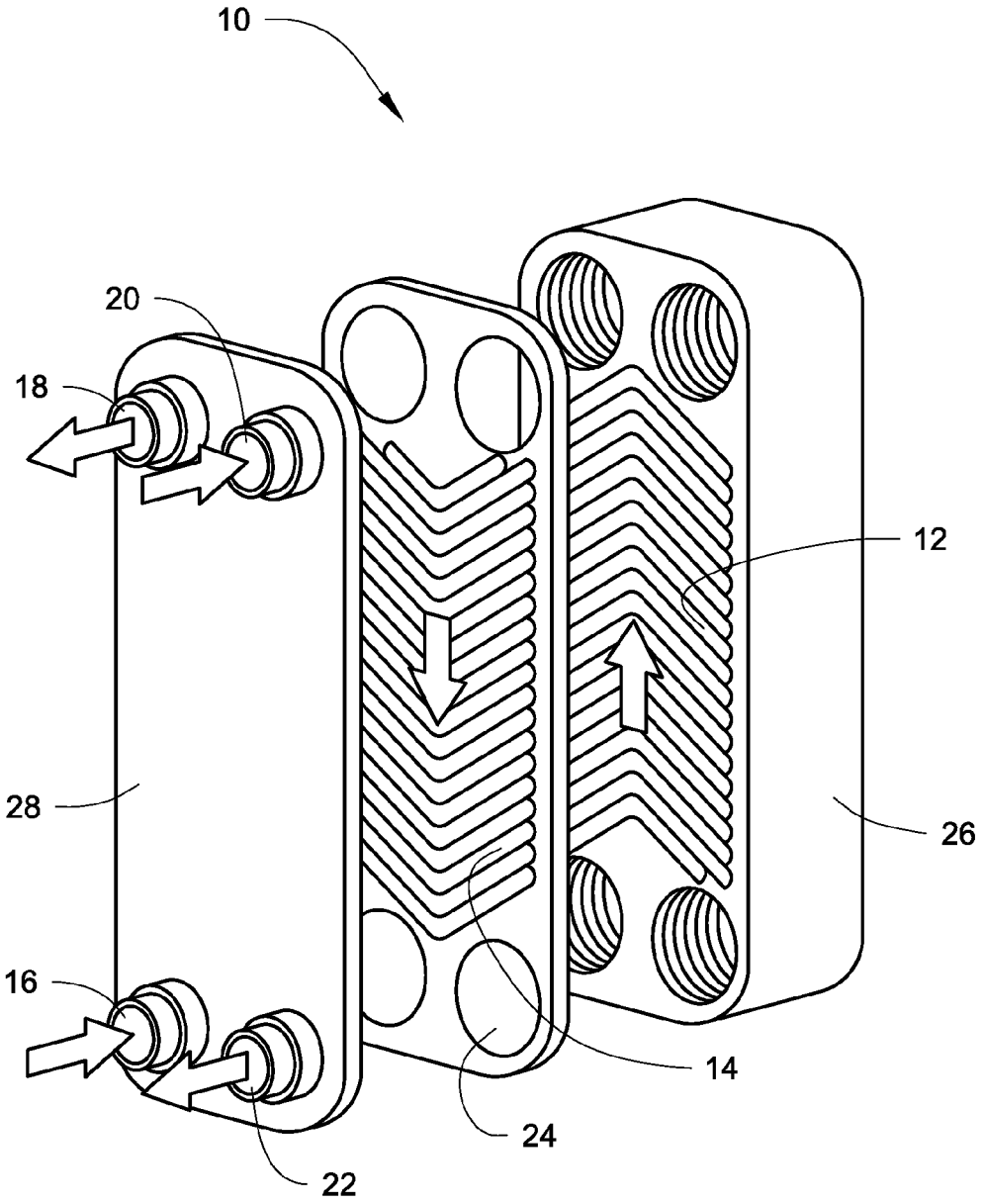
FIG. 1 is perspective view of an example brazed plate heat exchanger.

FIG. 1 shows one example of a brazed plate heat exchanger (BPHE) 10. The BPHE 10 can be composed of corrugated metallic sheets, see e.g. 12 and 14, which are brazed together. As shown, plate 14 allows one fluid stream for example a source stream, such as a chilled fluid which may be water, to flow on one side, while plate 12 allows another fluid stream, for example a refrigerant stream to flow on the other side. The fluids exchange heat for example such that the fluid stream flowing through plate 12 cools the fluid stream (e.g. water) flowing through plate 14. A cover 28 can have openings 16, 18, 20, and 22 that are respective inlets and outlets for each of the fluid streams. Plate 14 can have openings 24 in fluid communication with the openings 16, 18, 20, and 22 to allow flow into and out of each of plates 12, 14. A cover 26 can close the other side of the BPHE 10.

A BPHE, such as BPHE 10, can be capable of handling a variety of flow situations. One flow situation is a fluid stream exchanging energy with one other fluid stream. In other flow situations, such as described in the apparatuses and methods herein, multiple fluid streams can interact within one unified brazed heat exchanger. For instance, two refrigerant circuits can exchange heat with a common working fluid circuit, such as but not limited to for example a water circuit or a glycol circuit. It is possible to braze more than one BPHE together to form a side-by-side, back-to-back, or adjacent arrangements of heat exchangers.

Figure 2:
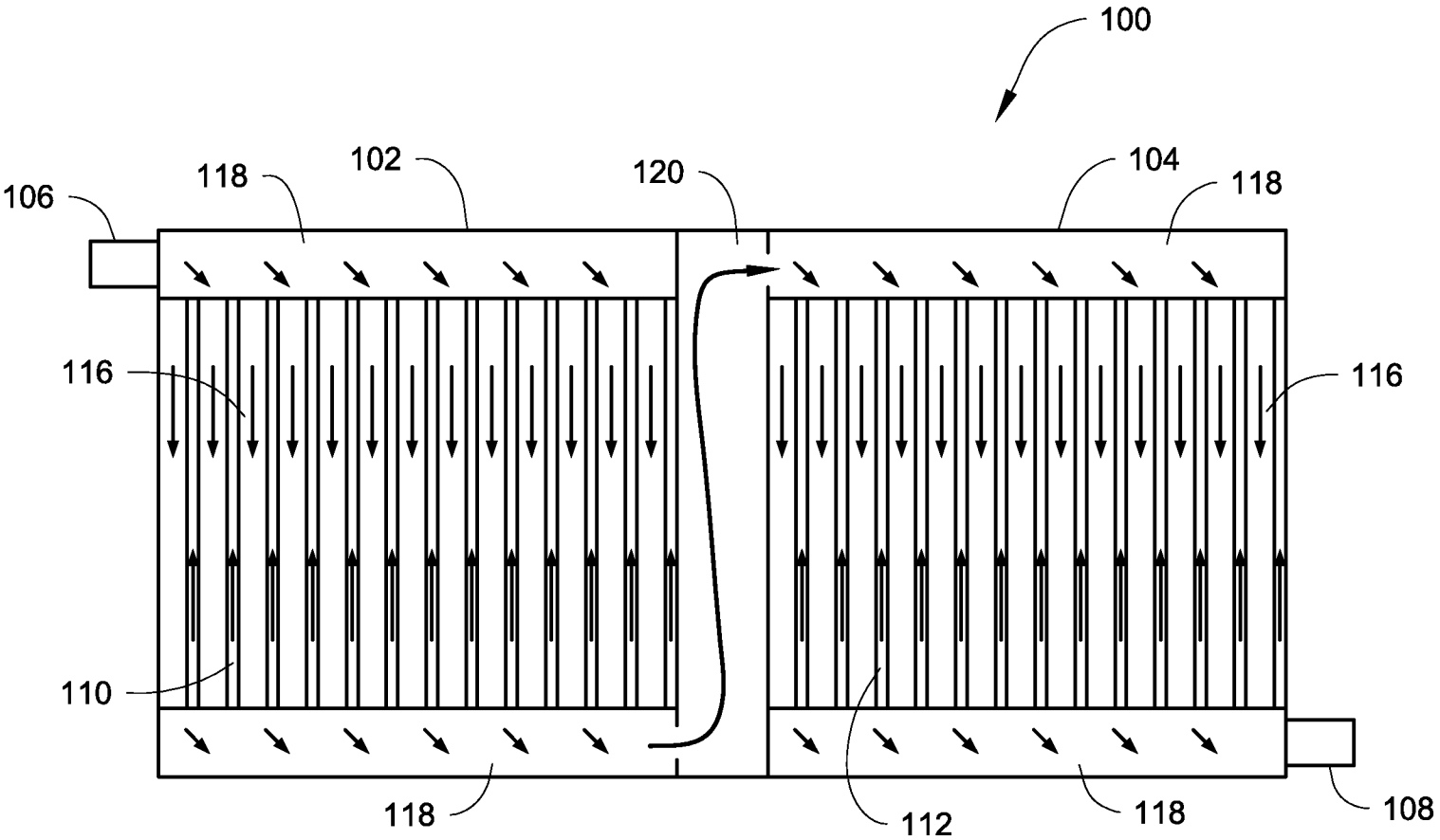
FIG. 2 is a schematic plan view of an embodiment of an apparatus to exchange heat serially with more than one heat exchange fluid circuit.

FIG. 2 is a schematic plan view of one embodiment of an apparatus 100 to exchange heat serially with more than one heat exchange fluid circuit, e.g. 102, 104 which can act as separate heat exchangers. In one embodiment, the apparatus 100 can be a series integrated brazed exchanger that brings together the thermodynamic benefit of series water pass through multiple circuit refrigeration equipment, e.g. performing serial heat exchanges, but where the apparatus 100 is constructed and arranged as a single component and unified brazed plate heat exchanger structure. In some examples a chilled fluid, such as water or glycol, enters the apparatus 100 at inlet 106. It is then routed internally to exchange heat with the first refrigerant circuit, e.g. heat exchanger 102. Depending on the particular application, the fluid flow of chilled fluid through the internal channels of the first heat exchanger 102 can be arranged for example but not limited to counter flow, parallel flow, or cross flow. After interaction with the first refrigerant circuit (e.g. first exchanger 102) is complete, the chilled fluid is routed internally to interact with the second refrigerant circuit, e.g. second heat exchanger 104. In such a configuration, the chilled fluid routing during the entire process takes place internally. It will be appreciated that the flow passages to route the flow of chilled fluid through the first and second circuits, e.g. first and second heat exchangers 102, 104 can be specifically designed, configured, and oriented so as to provide adequate and/or optimum flow with respect to the first circuit and second circuit. It will also be appreciated that additional circuits may be employed in a cascading configuration. For example, the chilled fluid outlet 108 shown in FIG. 2 may be structured as another one or more internal routing channels to add on another circuit, which may be similar to 102, 104.

In the configuration shown in FIG. 2, the apparatus 100 can be constructed and arranged as a single entity, which can eliminate the need for external piping, the number of piping joints can be reduced, and handling and servicing of one entity can be suitable to handling and applying two or more units.

With further reference to FIG. 2, the fluid flow may be as follows. For convenience of description, water can be the chilled fluid for the embodiment shown and the apparatus 100 is one in which its heat exchangers act as evaporators. Relatively warm water enters the chilled fluid inlet 106. Then, in this example, the water flows downward through the channel matrix or working fluid channels 116. In the embodiment shown, the water flow is a counter flow relative to the first heat exchange fluid, e.g. refrigerant, circulating in the first circuit, e.g. heat exchanger 102. The refrigerant absorbs energy from the water and boils, and can leave in gaseous form for example through an outlet (not shown) toward the top of the heat exchanger 102. In some embodiments, if the amount of heat exchange is sufficient, then the refrigerant may be boiled to a superheated condition which may be useful for other purposes in the first circuit. In turn, the water is cooled in this process of heat exchange with the first heat exchanger 102. After passing through the working fluid channels associated with the first heat exchanger 102, the water may be routed from the bottom of the first heat exchanger 102 to the second heat exchanger 104. In some embodiments, the water is routed back to the top of the apparatus 100 to begin the process of heat exchange with the second refrigerant circuit, e.g. second heat exchanger 104. The routing is accomplished through one or more internal routing channels 120. In some embodiments, the internal routing channels 120 do not allow heat to be exchanged, or at least allow only a very little heat transfer with either refrigerant circuit, e.g. heat exchangers 102, 104, such that the benefits of the cascade effect may still be realized. Generally, the internal routing channels 120 are configured to position the water for introduction into a heat exchange relationship with the second circuit, e.g. into second heat exchanger 104. The water can then flow through the brazed channel matrix, e.g. the working fluid channels 116, of the second heat exchanger 104. It will be appreciated that in some embodiments, other flow chambers, channels, headers, or other flow path structures, as depicted by 118 in FIG. 2, may also be employed to route the chilled fluid.

Similar to the process occurring in the first circuit, the refrigerant is boiled off and leaves the second heat exchanger 104 through the second heat exchange fluid channels 112, while the water cools off. Finally, the water is routed to the outlet 108 and may then leave the heat exchanger 104 and/or the apparatus 100.

It will be appreciated that the apparatus 100 can include additional circuits, for example sequentially added in a similar arrangement as the second circuit, e.g. second heat exchanger 104, is added to the first circuit, e.g. first heat exchanger 102.

In such a configuration, the outlet 108 can be replaced with additional internal routing channel(s) and be disposed further downstream until after the last circuit has been incorporated. The resulting chilled fluid, e.g. water, can then be circulated such as by using conventional implementations, to cool an industrial process, provide air conditioning, cool food or provide some useful benefit to society.

Thus, as shown in FIG. 2, the first brazed heat exchanger 102 can have a working fluid inlet 106 in fluid communication with a working fluid circuit, and a first heat exchanger fluid inlet and outlet (see e.g. 214*a*, 214*b* in FIG. 3) in fluid communication with a first heat exchange fluid circuit. The first heat exchanger fluid inlet and outlet are configured to allow fluid flow of a first heat exchange fluid into and out of the first brazed heat exchanger 102. The first brazed heat exchanger 102 includes working fluid flow channels 116 in fluid communication with the working fluid inlet 106, and includes first heat exchanger fluid flow channels 110 in fluid communication with the first heat exchanger fluid inlet and outlet. The working fluid channels 116 are configured relative to the first heat exchanger fluid flow channels 110 so that the working fluid flowing through the working fluid flow channels 116 exchanges heat with the first heat exchange fluid flowing through the first heat exchanger fluid channels 110. The internal flow path includes the working fluid flow channels 110 of the first brazed heat exchanger 102 and the one or more internal routing channels 120.

In one embodiment, the second brazed heat exchanger 104 has working fluid flow channels 116 in fluid communication with the one or more internal routing channels 120. The second brazed heat exchanger 104 includes a second heat exchanger fluid inlet and outlet (see e.g. 214*c*, 214*d* in FIG. 3) in fluid communication with a second heat exchange fluid circuit that is separate from the first heat exchange fluid circuit. The second heat exchanger fluid inlet and outlet are configured to allow fluid flow of a second heat exchange fluid into and out of the second brazed heat exchanger 104. The second brazed heat exchanger 104 includes second heat exchanger fluid flow channels 112 in fluid communication with the second heat exchanger fluid inlet and outlet. The working fluid channels 116 of the second brazed heat exchanger 104 are configured relative to the second heat exchanger fluid flow channels 112 so that the working fluid flowing through the working fluid flow channels 116 exchanges heat with the second heat exchange fluid flowing through the second heat exchanger fluid channels 112. The second brazed heat exchanger 104 includes an outlet 108 in fluid communication with the working fluid flow channels 116 of the second brazed heat exchanger 104. The internal flow path includes the working fluid flow channels 116 of the second brazed heat exchanger 104.

The internal flow path thus comprises the working fluid flow channels 116 of first brazed heat exchanger 102, the one or more internal routing channels 120, and the working fluid flow channels 116 of the second brazed heat exchanger 104. The one or more internal routing channels 120 are in fluid communication with the working fluid flow channels 116, such that the working fluid exits the first brazed heat exchanger 102 and enters the second brazed heat exchanger 104 internally of the apparatus 100, and so that working fluid does not route from an external exit of the first brazed heat exchanger 102 does not route to an external entrance of the second brazed heat exchanger 104.

By "internal" flow path, it is meant that that fluid flow from the first heat exchanger 102 to the second heat exchanger 104 is not from an external outlet of the first heat exchanger to an external inlet of the second heat exchanger.

In one embodiment, the first and/or the second brazed heat exchangers 102, 104 are brazed plate heat exchangers.

In one embodiment, the internal routing channel(s) 120 can be disposed between the first and second brazed heat exchangers 102, 104.

In one embodiment, a divider is disposed between the first and second brazed heat exchangers 102, 104.

In one embodiment, the one or more routing channels 120 make up the divider between the first and second heat exchangers 102, 104.

In one embodiment, the first brazed heat exchanger 102, the one or more routing channels 120, and the second brazed heat exchanger 104 are constructed and arranged as a single unit, such as shown, without external piping for the internal flow path. In one embodiment, the apparatus 100 is a single entity, constructed and arranged as a single component.

In one embodiment, the configuration of the working fluid flow channels 116 relative to the heat exchanger fluid flow channels 110, 112, in the first and/or second brazed heat exchanger 102, 104, can be constructed and arranged in various ways that include but are not limited to counter flow, parallel flow, cross flow, or the like.

In one embodiment, the apparatus 100 and heat exchangers 102, 104 used herein can be implemented in a cascade effect using multiple heat exchange fluid circuits, which may run through a single apparatus or employ multiple apparatuses herein to account for the number of heat exchange fluid circuits leveraged.

It will be appreciated that specific flow configurations through the heat exchangers 102, 104, placement and configuration of the internal routing channel(s) as shown in FIG. 2 are merely exemplary and are not meant to be limiting. Other configurations may also be suitable that arrange the respective elements in manner that is different from what is shown in FIG. 2.

Figure 3:
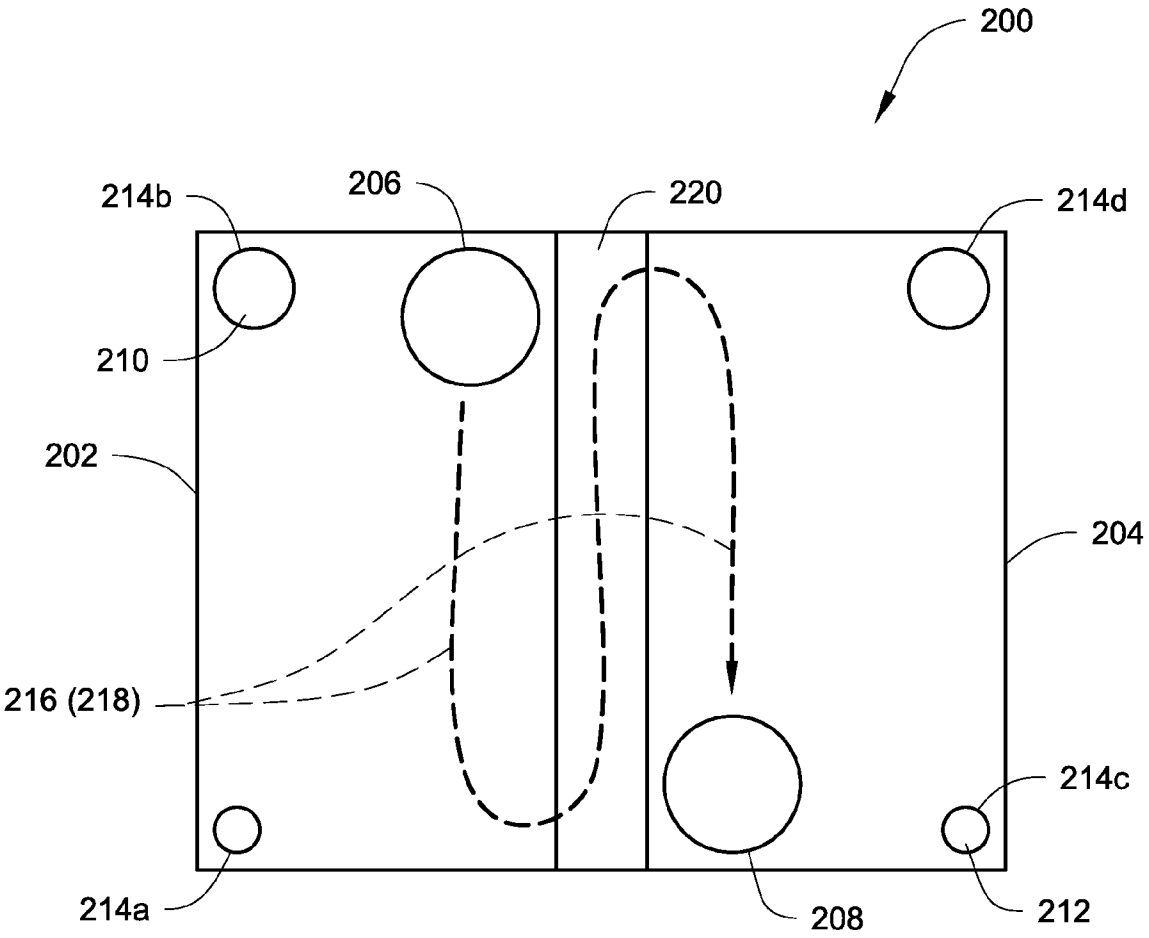
FIG. 3 is a schematic plan view of an embodiment of an apparatus to exchange heat serially with more than one heat exchange fluid circuit.

FIG. 3 is a schematic plan view of another embodiment of an apparatus 200 to exchange heat serially with more than one heat exchange fluid circuit. FIG. 3 shows a different flow orientation, which could be designed within a plate stack and which could achieve the same effect as in FIG. 2. In FIG. 3, the first and second circuits may be split, for example in a side to side configuration, and where the split includes one or more routing channels oriented generally vertically. Similar reference numbers correspond to those used in FIG. 2. The apparatus 200 includes a first heat exchanger 202, a second heat exchanger 204, and one or more internal routing channels 220. The first heat exchanger 202 has an inlet 206, and the second heat exchanger 204 can have an outlet 208. Working fluid channels 216 are schematically shown (and suitable other flow chambers, channels, headers, or other flow path structures may be used, as depicted by 218). First and second heat exchange fluid channels 210, 212 are also shown. Also, shown are the inlets, outlets 214*a*, 214*b*, 214*c*, and 214*d* which are respectively in fluid communication with the first and second heat exchange fluid channels 210, 212.

It will be appreciated that the orientation of the flow through the first and second heat exchangers and the routing channel(s) is not meant to be limiting. In other examples, a diagonal split may be useful, depending on BPHE manufacturing and depending on the flow designs.

It will be appreciated that the one or more internal routing channels may be sized with an appropriate width, wall thickness, and surface characteristics to achieve a desired fluid flow through the internal routing chambers. Likewise, the routing channels may be constructed in a manner and of a material that can achieve a desired thermoconductivity and/or insulation, for example relative to other parts of the apparatus including but not limited to the first and second heat exchangers.

It will also be appreciated that existing system pressures, e.g. from an external pump which may be present in the system and/or unit for example a pump of a chiller, may be employed to provide the fluid pressure to drive the fluid through the apparatus.

It will be appreciated that the apparatuses of FIGS. 2 and 3 may be incorporated in systems and/or units that include for example multiple circuited chillers.

Two other approaches that differ from FIGS. 2 and 3 may also be incorporated in multiple circuited chillers, and which are described below with respect to FIGS. 4 to 6.

Figure 4B:
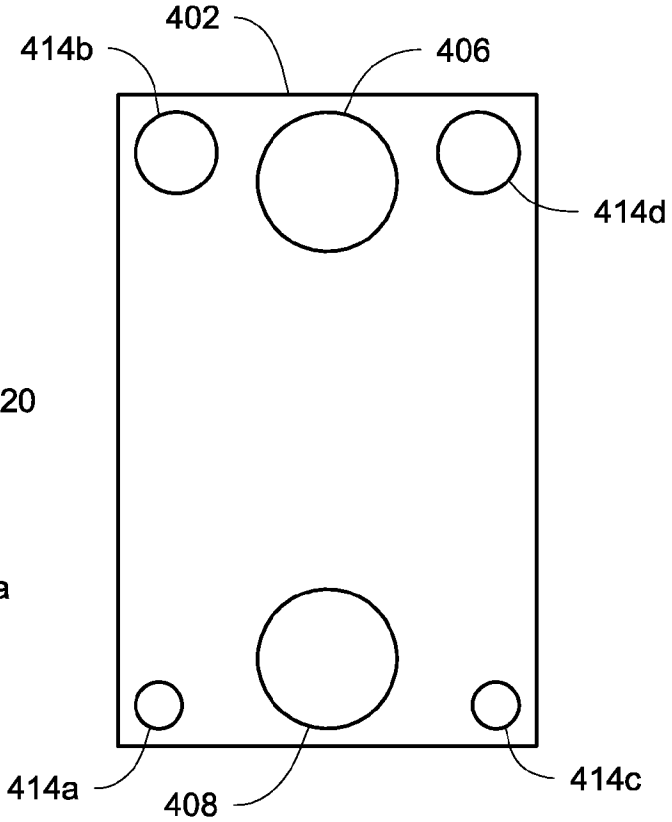
FIGS. 4A and 4B show a schematic plan view of another embodiment of an apparatus to exchange heat serially with more than one heat exchange fluid circuit.
Figure 4A:
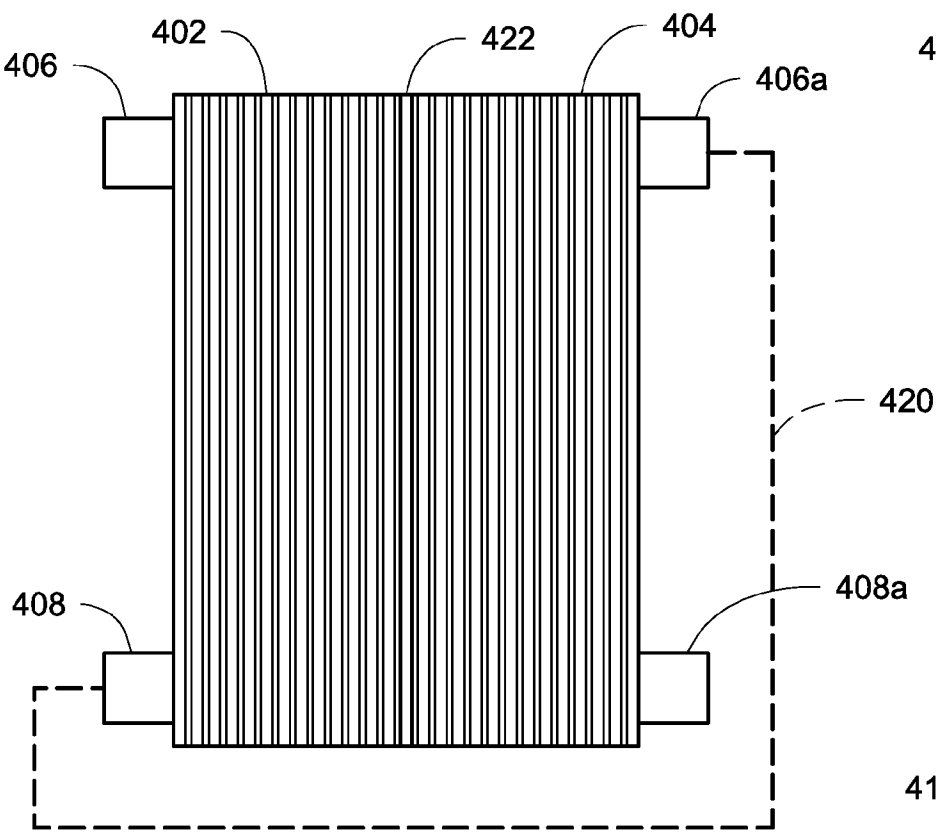

FIGS. 4A and 4B show a series arranged BPHE with a configuration of back-to-back circuits and external piping 420. FIGS. 4A and 4B show multiple separate heat exchangers, e.g. two heat exchangers, which are divided by a divider plate 422. FIGS. 4A and 4B thus show a single exchanger comprised of two independent exchangers 402, 404 brazed together back-to-back. Here, the chilled fluid is routed completely through one heat exchanger (on the left) through 406, 408 and exchange heat with fluid flowing through inlet 214*a* to outlet 214*b*, leaves the first heat exchanger at 408, is routed to the second heat exchanger through 406*a*, 408*a*, and then through the other (on the right) in a series fashion, but using the external piping. With this arrangement, an improvement in the chiller system COP may be realized relative to an interlaced concept (described below with respect to FIGS. 5 and 6). Some potential drawbacks of the external piping configuration is the additional external piping which must be provided to route the chilled fluid stream from one exchanger (or one half for back-to-back) to the other side. The external piping can increase the footprint of the overall apparatus. Further, pressure losses may penalize efficiencies gained due to the number of bends (see e.g. four bends in the external piping) that may be present in the routing of the external tubing. Further, due to the use of external tubing there may be some heat transfer losses to the environment.

Figure 6:
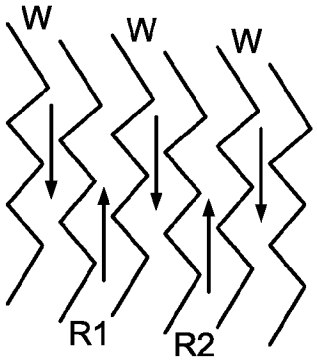
FIG. 6 shows a fluid flow scheme consistent with the apparatus shown in FIG. 5.
Figure 5B:
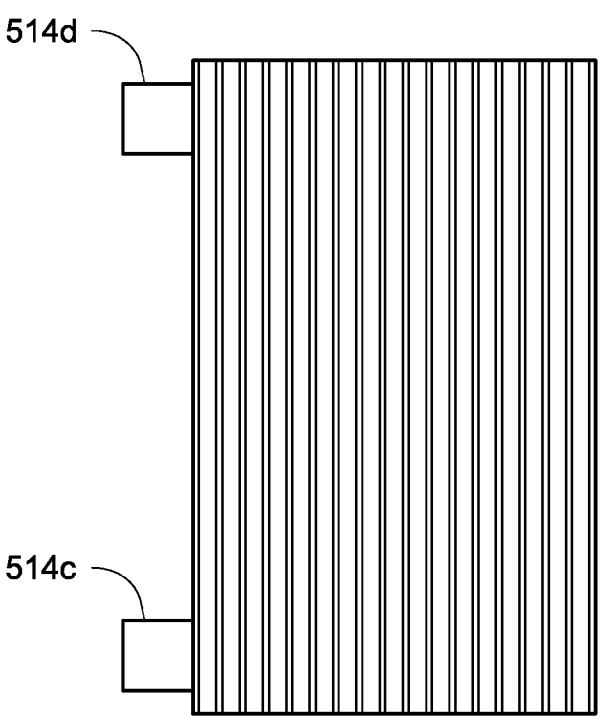
FIGS. 5A and 5B show a schematic plan view of another embodiment of an apparatus to exchange heat serially with more than one heat exchange fluid circuit.
Figure 5A:
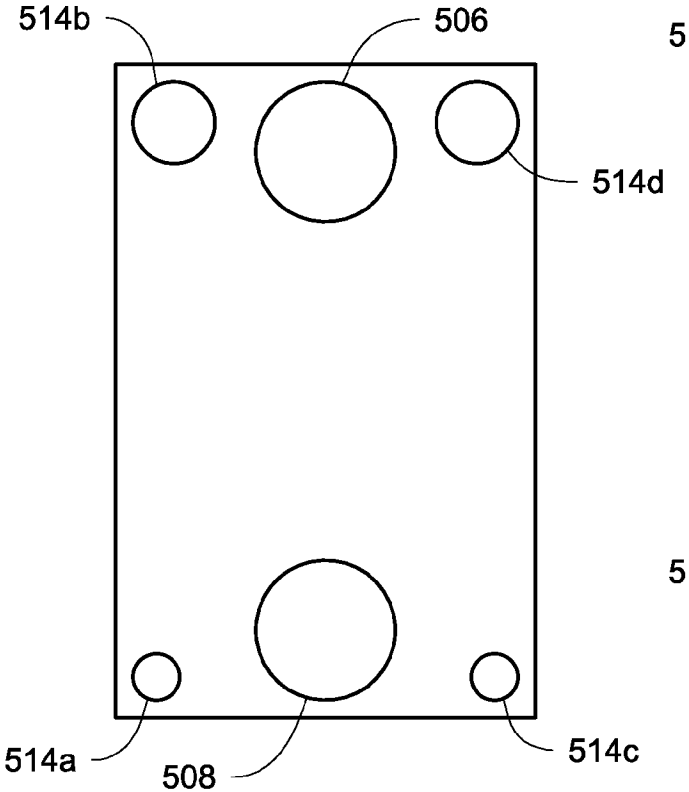

FIGS. 5A, 5B, and 6 show an interlaced construction method of a heat exchanger apparatus 500, but where the heat exchange is not serial and so improvements in COP may not be realized. FIG. 5 shows a front view (left) and a side view (right). In this arrangement, the internal passages of the BPHE direct flow through alternating channels. See e.g. FIG. 6. The chilled fluid (W) flows through the first channel, then refrigerant from circuit 1 (R1) flows through the next channel. This is followed by another water channel (W) which is followed by refrigerant flowing through circuit 2 (R2) then the pattern repeats. In this case, the two refrigerant circuits exchange heat with the same chilled fluid stream. Thus the heat exchange rate and ultimately the same exit temperature will be developed for both refrigerant circuits, resulting in identical refrigerant conditions leaving the heat exchanger. Thus the COP developed in each of the circuits will generally be the same.

FIG. 5 shows an example of interlaced, dual circuit brazed plate heat exchanger 500. Openings on the left 514*a*, 514*b* represent entry and exit of refrigerant from circuit 1. Openings on the right 514*c*, 514*d* represent entry and exit of refrigerant from circuit 2. Openings in the middle 506, 508 represent entry and exit of chilled fluid. FIG. 6 shows the flow streams inside an interlaced, dual circuit brazed plate heat exchanger, such as shown in FIG. 5.

Aspects

It will be appreciated that any one of the aspects below may be combined with any one or more of the other aspects below.

Aspect. Brazed heat exchangers are described, and which may be brazed plate heat exchangers, and used for example in a heating, ventilation, and air conditioning system (HVAC) system and/or unit thereof.

Aspect. Generally, the heat exchanger includes a flow structure to allow a fluid stream, for example a chilled fluid stream to exchange heat serially with more than one refrigerant circuit where each refrigerant circuit is a distinct and independent refrigerant circuit.

Aspect. In one embodiment, an apparatus to exchange heat serially with more than one heat exchange fluid circuit includes an internal flow path that allows a working fluid to flow through a first brazed heat exchanger, through one or more internal routing channels, and through a second brazed heat exchanger.

Aspect. In one embodiment, the first brazed heat exchanger has a working fluid inlet in fluid communication with a working fluid circuit, and a first heat exchanger fluid inlet and outlet in fluid communication with a first heat exchange fluid circuit. The first heat exchanger fluid inlet and outlet are configured to allow fluid flow of a first heat exchange fluid into and out of the first brazed heat exchanger. The first brazed heat exchanger includes working fluid flow channels in fluid communication with the working fluid inlet, and includes first heat exchanger fluid flow channels in fluid communication with the first heat exchanger fluid inlet and outlet. The working fluid channels are configured relative to the first heat exchanger fluid flow channels so that the working fluid flowing through the working fluid flow channels exchanges heat with the first heat exchange fluid flowing through the first heat exchanger fluid channels.

Aspect. The internal flow path includes the working fluid flow channels of the first brazed heat exchanger and the one or more internal routing channels.

Aspect. In one embodiment, the second brazed heat exchanger has working fluid flow channels in fluid communication with the one or more internal routing channels. The second brazed heat exchanger includes a second heat exchanger fluid inlet and outlet in fluid communication with a second heat exchange fluid circuit that is separate from the first heat exchange fluid circuit. The second heat exchanger fluid inlet and outlet are configured to allow fluid flow of a second heat exchange fluid into and out of the second brazed heat exchanger. The second brazed heat exchanger includes second heat exchanger fluid flow channels in fluid communication with the second heat exchanger fluid inlet and outlet. The working fluid channels of the second brazed heat exchanger are configured relative to the second heat exchanger fluid flow channels so that the working fluid flowing through the working fluid flow channels exchanges heat with the second heat exchange fluid flowing through the second heat exchanger fluid channels. The second brazed heat exchanger includes an outlet in fluid communication with the working fluid flow channels of the second brazed heat exchanger.

Aspect. The internal flow path includes the working fluid flow channels of the second brazed heat exchanger.

Aspect. The internal flow path thus comprises the working fluid flow channels of first brazed heat exchanger, the one or more internal routing channels, and the working fluid flow channels of the second brazed heat exchanger.

Aspect. The one or more internal routing channels are in fluid communication with the working fluid flow channels, such that the working fluid exits the first brazed heat exchanger and enters the second brazed heat exchanger internally of the apparatus, and so that working fluid does not route from an external exit of the first brazed heat exchanger does not route to an external entrance of the second brazed heat exchanger.

Aspect. By "internal" flow path, it is meant that that fluid flow from the first heat exchanger to the second heat exchanger is not from an external outlet of the first heat exchanger to an external inlet of the second heat exchanger.

Aspect. In one embodiment, the first and/or the second brazed heat exchangers are brazed plate heat exchangers.

Aspect. In one embodiment, the internal routing channel(s) can be disposed between the first and second brazed heat exchangers.

Aspect. In one embodiment, a divider is disposed between the first and second brazed heat exchangers.

Aspect. In one embodiment, the one or more routing channels make up the divider between the first and second heat exchangers.

Aspect. In one embodiment, the first brazed heat exchanger, the one or more routing channels, and the second brazed heat exchanger are constructed and arranged as a single unit, without external piping for the internal flow path. In one embodiment, the apparatus is a single entity, constructed and arranged as a single component.

Aspect. In one embodiment, the configuration of the working fluid flow channels relative to the heat exchanger fluid flow channels, in the first and/or second brazed heat exchanger, can be constructed and arranged in various ways that include but are not limited to counter flow, parallel flow, cross flow, or the like.

Aspect. In one embodiment, the apparatus and heat exchangers used therein can be implemented in a cascade effect using multiple heat exchange fluid circuits, which may run through a single apparatus or employ multiple apparatuses herein to account for the number of heat exchange fluid circuits leveraged.

Aspect. In one embodiment, a method to exchange heat from a working fluid serially with more than one heat exchange fluid circuit includes directing a working fluid through an internal flow path that directs the working fluid to flow through a first brazed heat exchanger, through one or more internal routing channels, and through a second brazed heat exchanger.

Aspect. In one embodiment, the method includes directing the working fluid into an inlet of the first brazed heat exchanger, and directing a first heat exchange fluid into another inlet of the first heat exchanger. The working fluid is directed through working fluid channels of the first brazed heat exchanger, and the first heat exchange fluid is directed through first heat exchanger fluid channels. The working fluid flowing through the working fluid channels of the first brazed heat exchanger exchanges heat with the first heat exchange fluid flowing through the first heat exchanger fluid channels. The working fluid is directed to one or more internal routing channels, and is internally routed to the second brazed heat exchanger, and through working fluid channels of the second heat exchanger. A second heat exchange fluid is directed into an inlet of the second brazed heat exchanger and through second heat exchanger fluid channels. The working fluid flowing through the working fluid flow channels of the second brazed heat exchanger exchanges heat with the second heat exchange fluid flowing through the second heat exchanger fluid channels. The working fluid is directed to an outlet in fluid communication with the working fluid flow channels of the second brazed heat exchanger.

Aspect. The apparatuses and methods herein and the brazed heat exchangers described herein may be used for example in a heating, ventilation, and air conditioning system (HVAC) system and/or unit thereof.

Aspect. For example, the apparatuses and methods herein can be used with various types of water chillers, that may use various types of compressors including but not limited to scroll, screw, reciprocating compressors, and that may have varying capacities including but not limited to about 10 ton to about 100 ton cooling capacity, which may make use of the compact and low inventory requirements of brazed heat exchangers.

Aspect. In some embodiments, the refrigerant which may be used may include but are not limited to relatively high pressure refrigerants that are relatively dense. It will be appreciated that depending on the BPHE manufacture and flow designs other refrigerants may be suitable for use with the apparatuses and methods herein.

Aspect. It will be appreciated, however, that as certain designs become larger, such as for example, at about 120 tons to higher at about 150 tons to about 250 tons, where flow rates and distributions may be adequately addressed to avail use of brazed heat exchangers.

Aspect. In one embodiment, the HVAC systems and/or units in which the apparatuses and methods herein may be suitable can include scroll compressor water chillers at about 10 ton to about 100 ton cooling capacity.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. A brazed heat exchanger apparatus, comprising:

a first brazed heat exchanger including a working fluid inlet in fluid communication with working fluid flow channels, a first heat exchanger fluid inlet in fluid communication with first heat exchanger fluid flow channels, the first heat exchanger fluid flow channels in fluid communication with a first heat exchanger outlet, the first heat exchanger fluid inlet, fluid flow channels, and outlet are configured to allow fluid flow of a first heat exchange fluid into and out of the first brazed heat exchanger, the working fluid channels are configured relative to the first heat exchanger fluid flow channels so that the working fluid flowing through the working fluid flow channels exchanges heat with the first heat exchange fluid flowing through the first heat exchanger fluid channels;

one or more internal routing channels in fluid communication with the working fluid flow channels of the first brazed heat exchanger;

a second brazed heat exchanger connected with the first brazed heat exchanger, the second brazed heat exchanger includes working fluid flow channels in fluid communication with the one or more internal routing channels, a second heat exchanger fluid inlet in fluid communication with second heat exchanger fluid flow channels, the second heat exchanger fluid flow channels in fluid communication with a second heat exchanger outlet, the second heat exchanger fluid inlet, fluid flow channels, and outlet are configured to allow fluid flow of a second heat exchange fluid into and out of the second brazed heat exchanger, the working fluid channels of the second brazed heat exchanger are configured relative to the second heat exchanger fluid flow channels so that the working fluid flowing through the working fluid flow channels exchanges heat with the second heat exchange fluid flowing through the second heat exchanger fluid channels, wherein an internal flow path of the apparatus includes the working fluid flow channels of the first brazed heat exchanger, the one or more internal routing channels, and the working fluid flow channels of the second brazed heat exchanger, the internal flow path configured so that the working fluid exchanges heat serially first through the first brazed heat exchanger and then through the second brazed heat exchanger, and wherein the one or more internal routing channels are connected to the working fluid flow channels of the first brazed heat exchanger at a position longitudinally opposite where the one or more internal routing channels are connected to the working fluid flow channels of the second brazed heat exchanger.

2. The apparatus of claim 1, wherein the one or more internal routing channels are in fluid communication with the working fluid flow channels of the first and second brazed heat exchangers, such that the working fluid exits the first brazed heat exchanger and enters the second brazed heat exchanger internally of the apparatus, and so that working fluid does not route from an external exit of the first brazed heat exchanger and does not route to an external entrance of the second brazed heat exchanger.

3. The apparatus of claim 1, wherein at least one of the first brazed heat exchanger and the second brazed heat exchanger are brazed plate heat exchangers.

4. The apparatus of claim 1, wherein the one or more internal routing channels are disposed between the first and second brazed heat exchangers.

5. The apparatus of claim 1, further comprising a divider disposed between the first and second brazed heat exchangers.

6. The apparatus of claim 5, wherein the one or more routing channels pass through the divider between the first and second brazed heat exchangers.

7. The apparatus of claim 1, wherein the first brazed heat exchanger, the one or more routing channels, and the second brazed heat exchanger are constructed and arranged as a single unit, without external piping for the internal flow path.

8. The apparatus of claim 1, wherein the working fluid flow channels relative to the heat exchanger fluid flow channels, in the first and/or second brazed heat exchanger, are constructed and arranged relative to each other in a counter flow, parallel flow, or cross flow configuration.

9. The apparatus of claim 1, wherein the first heat exchanger fluid inlet is in fluid communication with a first heat exchange fluid circuit, the second heat exchanger fluid inlet is in fluid communication with a second heat exchange fluid circuit, the second heat exchange fluid circuit is separate from the first heat exchange fluid circuit.

10. A heating, ventilation, and air conditioning system (HVAC) unit, comprising the apparatus of claim 1.

11. The unit of claim 10, further comprising a water chiller having about 10 ton to about 100 ton cooling capacity.

12. A method to exchange heat from a working fluid serially with more than one heat exchange fluid circuit, comprises directing a working fluid through an internal flow path, which includes directing the working fluid to flow through a first brazed heat exchanger and exchanging heat with a first heat exchange fluid flowing through the first brazed heat exchanger, directing the working fluid through one or more internal routing channels, wherein the one or more internal routing channels are connected to working fluid flow channels of the first brazed heat exchanger at a position longitudinally opposite where the one or more internal routing channels are connected to working fluid flow channels of a second brazed heat exchanger, and directing the working fluid through the second brazed heat exchanger and exchanging heat with a second heat exchange fluid flowing through the second brazed heat exchanger wherein a brazed heat exchanger apparatus comprising: the first brazed heat exchanger including a working fluid inlet in fluid communication with the working fluid flow channels, a first heat exchanger fluid inlet in fluid communication with first heat exchanger fluid flow channels, the first heat exchanger fluid flow channels in fluid communication with a first heat exchanger outlet, the first heat exchanger fluid inlet, fluid flow channels, and outlet are configured to allow fluid flow of the first heat exchange fluid into and out of the first brazed heat exchanger, the working fluid channels are configured relative to the first heat exchanger fluid flow channels so that the working fluid flowing through the working fluid flow channels exchanges heat with the first heat exchange fluid flowing through the first heat exchanger fluid channels;

the one or more internal routing channels in fluid communication with the working fluid flow channels of the first brazed heat exchanger;

the second brazed heat exchanger connected with the first brazed heat exchanger, the second brazed heat exchanger includes the working fluid flow channels in fluid communication with the one or more internal routing channels, a second heat exchanger fluid inlet in fluid communication with second heat exchanger fluid flow channels, the second heat exchanger fluid flow channels in fluid communication with a second heat exchanger outlet, the second heat exchanger fluid inlet, fluid flow channels, and outlet are configured to allow fluid flow of the second heat exchange fluid into and out of the second brazed heat exchanger, the working fluid channels of the second brazed heat exchanger are configured relative to the second heat exchanger fluid flow channels so that the working fluid flowing through the working fluid flow channels exchanges heat with the second heat exchange fluid flowing through the second heat exchanger fluid channels, wherein the internal flow path of the apparatus includes the working fluid flow channels of the first brazed heat exchanger, the one or more internal routing channels, and the working fluid flow channels of the second brazed heat exchanger, the internal flow path configured so that the working fluid exchanges heat serially first through the first brazed heat exchanger and then through the second brazed heat exchanger.

13. The method of claim 12, wherein directing the working fluid through the first brazed heat exchanger includes directing the working fluid into the first heat exchanger fluid inlet of the first brazed heat exchanger, and wherein exchanging heat with the first heat exchange fluid includes directing the first heat exchange fluid into another inlet of the first brazed heat exchanger, and further including directing the working fluid includes directing the working fluid through working fluid channels of the first brazed heat exchanger, directing the first heat exchange fluid through first heat exchanger fluid channels, wherein the working fluid flowing through the working fluid channels of the first brazed heat exchanger exchanges heat with the first heat exchange fluid flowing through the first heat exchanger fluid channels.

14. The method of claim 12, wherein directing the working fluid through one or more internal routing channels includes internally routing within the brazed heat exchange apparatus the working fluid from the first brazed heat exchanger to the second brazed heat exchanger.

15. The method of claim 12, wherein directing the working fluid through the second brazed heat exchanger includes directing the working fluid from the one or more routing channels into the second heat exchanger fluid inlet of the second brazed heat exchanger, and wherein exchanging heat with the second heat exchange fluid includes directing the second heat exchange fluid into another inlet of the second brazed heat exchanger, and further including directing the working fluid through working fluid channels of the second brazed heat exchanger, directing the second heat exchange fluid through second heat exchanger fluid channels, wherein the working fluid flowing through the working fluid flow channels of the second brazed heat exchanger exchanges heat with the second heat exchange fluid flowing through the second heat exchanger fluid channels.

16. The method of claim 15, further including directing the working fluid to the outlet in fluid communication with the working fluid flow channels of the second brazed heat exchanger.

* * * * *